US008322075B2

(12) United States Patent
Lahnala

(10) Patent No.: US 8,322,075 B2
(45) Date of Patent: Dec. 4, 2012

(54) CHANNEL SEAL FOR A SLIDING WINDOW ASSEMBLY

(75) Inventor: David W. Lahnala, Adrian, MI (US)

(73) Assignee: AGC Automotive Americas Co., Hebron, KY (US)

( * ) Notice: Subject to any disclaimer, the term of this patent is extended or adjusted under 35 U.S.C. 154(b) by 410 days.

(21) Appl. No.: 12/621,267

(22) Filed: Nov. 18, 2009

(65) Prior Publication Data

US 2010/0122494 A1 May 20, 2010

Related U.S. Application Data

(60) Provisional application No. 61/199,643, filed on Nov. 19, 2008.

(51) Int. Cl.
*E05D 15/06* (2006.01)

(52) U.S. Cl. ..... 49/413; 49/408; 49/380; 49/475.1

(58) Field of Classification Search ..... 49/380, 49/413, 475.1, 484.1, 408, 116, 118, 123
See application file for complete search history.

(56) References Cited

U.S. PATENT DOCUMENTS

| | | | | |
|---|---|---|---|---|
| 3,656,260 | A | 4/1972 | Weaver et al. | |
| 4,124,054 | A | 11/1978 | Spretnjak | |
| 4,635,398 | A | 1/1987 | Nakamura | |
| 4,688,752 | A | 8/1987 | Barteck et al. | |
| 4,785,583 | A | 11/1988 | Kawagoe et al. | |
| 4,788,796 | A | 12/1988 | Matthews | |
| 4,795,667 | A | 1/1989 | Armstrong | |
| 4,834,931 | A | 5/1989 | Weaver | |
| 4,962,601 | A | 10/1990 | Gold | |
| 4,969,293 | A | 11/1990 | Guillon | |
| 5,061,429 | A | 10/1991 | Yoshihara et al. | |
| 5,228,740 | A | 7/1993 | Saltzman | |
| 5,294,168 | A | 3/1994 | Kronbetter | |
| 5,345,717 | A | 9/1994 | Mori et al. | |
| 5,363,596 | A | 11/1994 | Kronbetter | |
| 5,442,880 | A | 8/1995 | Gipson | |
| 5,473,840 | A | 12/1995 | Gillen et al. | |
| 5,505,023 | A | 4/1996 | Gillen et al. | |
| 5,522,191 | A * | 6/1996 | Wenner et al. | 52/204.51 |
| 5,531,046 | A | 7/1996 | Kollar et al. | |

(Continued)

FOREIGN PATENT DOCUMENTS

GB 2159562 A 12/1985

(Continued)

*Primary Examiner* — Katherine W Mitchell
*Assistant Examiner* — Catherine A Kelly
(74) *Attorney, Agent, or Firm* — Howard & Howard Attorneys PLLC

(57) ABSTRACT

The present invention includes a sliding window assembly for a vehicle. The sliding window assembly comprises a first fixed panel configured for coupling with the vehicle and a second fixed panel configured for coupling with the vehicle. The second fixed panel is spaced from the first fixed panel to define an opening therebetween. A track is connected to the first fixed panel and to the second fixed panel and the track defines a U-shaped channel. The sliding window assembly also comprises a sliding panel disposed within the channel and moveable relative to the first and second fixed panels along the track for covering and uncovering the opening. The sliding window assembly further includes a channel seal having a finger contacting the sliding panel and a base extending from the finger and coupled to the track for sealing the channel from environmental elements.

22 Claims, 9 Drawing Sheets

U.S. PATENT DOCUMENTS

| | | | | |
|---|---|---|---|---|
| 5,551,193 | A | | 9/1996 | Barnett |
| 5,613,323 | A | | 3/1997 | Buening |
| 5,669,181 | A | | 9/1997 | Kollar et al. |
| 5,724,769 | A | | 3/1998 | Cripe et al. |
| 5,775,029 | A | | 7/1998 | Buening |
| 5,784,833 | A | | 7/1998 | Sponable et al. |
| 5,799,444 | A | | 9/1998 | Freimark et al. |
| 5,799,449 | A | | 9/1998 | Lyons et al. |
| 5,822,922 | A | | 10/1998 | Grumm et al. |
| 5,836,110 | A | | 11/1998 | Buening |
| 5,996,284 | A | | 12/1999 | Freimark et al. |
| 5,997,793 | A | | 12/1999 | Lahnala |
| 6,018,913 | A | | 2/2000 | Lin |
| 6,026,611 | A | | 2/2000 | Ralston et al. |
| 6,038,819 | A | | 3/2000 | Klein |
| 6,112,462 | A | | 9/2000 | Kolar |
| 6,119,401 | A | | 9/2000 | Lin et al. |
| 6,125,585 | A | | 10/2000 | Koneval et al. |
| 6,324,788 | B1 | | 12/2001 | Koneval et al. |
| 6,495,082 | B1 | | 12/2002 | Ash et al. |
| 6,591,552 | B1 | | 7/2003 | Rasmussen |
| 6,691,464 | B2 | | 2/2004 | Nestell et al. |
| 6,766,617 | B2 | | 7/2004 | Purcell |
| 6,810,622 | B2 | | 11/2004 | Oberheide |
| 6,872,353 | B2 | | 3/2005 | Gillen et al. |
| 6,890,468 | B2 | | 5/2005 | Caldoro et al. |
| 6,955,009 | B2 | | 10/2005 | Rasmussen |
| 6,962,350 | B2 | | 11/2005 | Berry et al. |
| 7,003,916 | B2 | | 2/2006 | Nestell et al. |
| 7,051,478 | B2 | | 5/2006 | Bourque et al. |
| 7,073,293 | B2 | | 7/2006 | Galer |
| 7,094,375 | B2 | | 8/2006 | Nakata |
| 7,150,126 | B2 | | 12/2006 | Rivera |
| RE40,636 | E | * | 2/2009 | Weinert et al. ..... 296/146.16 |
| 7,810,284 | B2 | * | 10/2010 | Murphy et al. ..... 49/380 |
| 2003/0188487 | A1 | | 10/2003 | Rasmussen |
| 2006/0032140 | A1 | | 2/2006 | Arimoto et al. |
| 2006/0107600 | A1 | | 5/2006 | Nestell et al. |
| 2007/0157522 | A1 | | 7/2007 | Hebert et al. |
| 2008/0060275 | A1 | | 3/2008 | Recker |
| 2008/0122262 | A1 | | 5/2008 | Cicala |
| 2008/0263960 | A1 | | 10/2008 | Murphy et al. |
| 2009/0019780 | A1 | | 1/2009 | Hansel et al. |
| 2009/0113802 | A1 | | 5/2009 | Cicala |
| 2009/0212591 | A1 | | 8/2009 | Seiple et al. |

FOREIGN PATENT DOCUMENTS

| | | | |
|---|---|---|---|
| GB | 2229479 | A | 9/1990 |
| WO | 2007090509 | A1 | 8/2007 |

* cited by examiner

FIG. 8
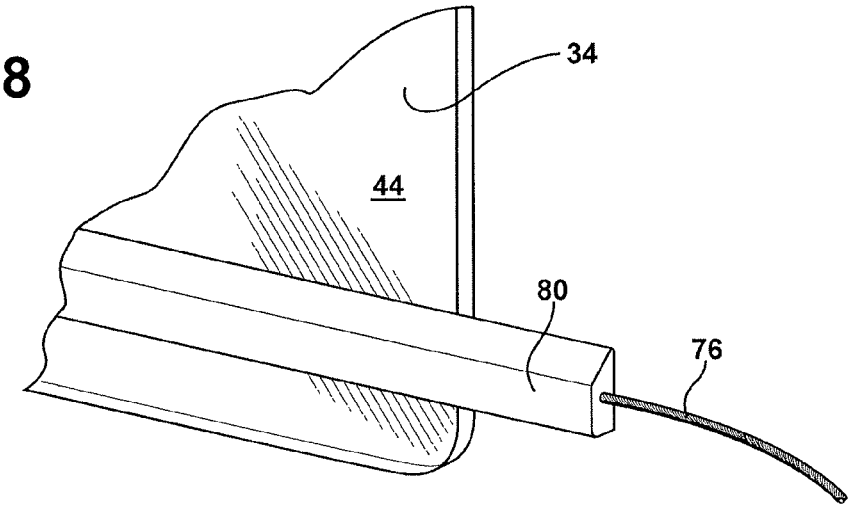
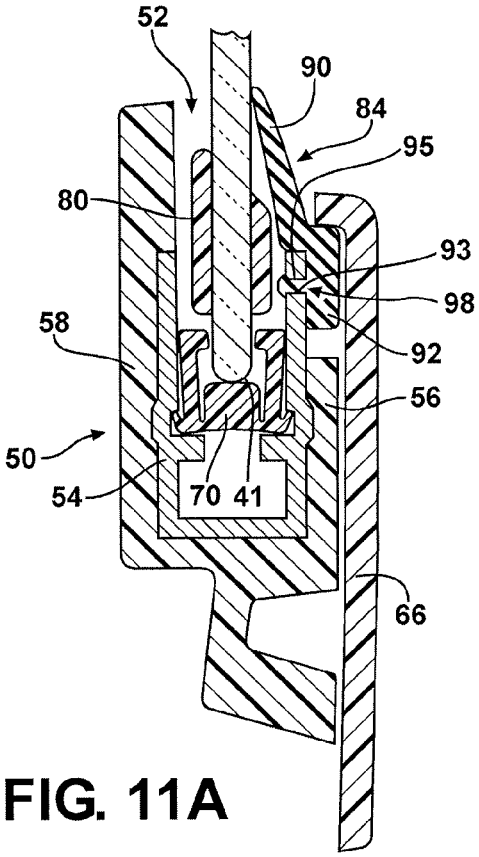
FIG. 11A
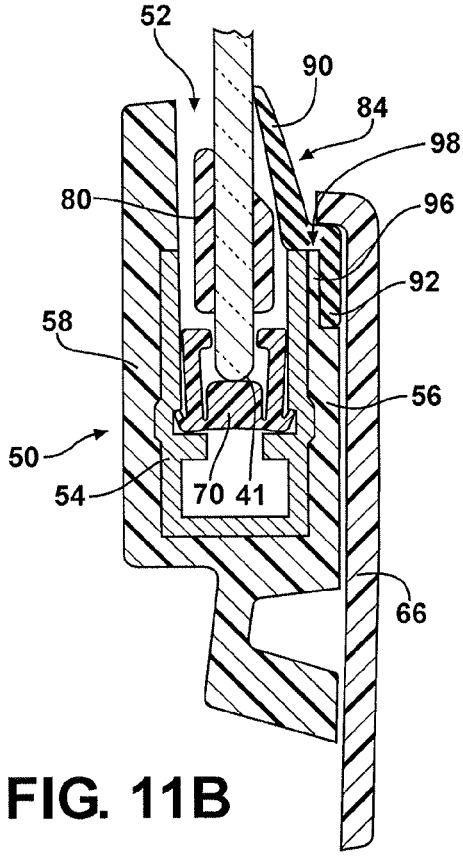
FIG. 11B

CHANNEL SEAL FOR A SLIDING WINDOW ASSEMBLY

CROSS-REFERENCE TO RELATED APPLICATIONS

The subject patent application claims priority to and all the benefits of U.S. Provisional Patent Application Ser. No. 61/199,643 which was filed on Nov. 19, 2008, the entire specification of which is expressly incorporated herein by reference.

BACKGROUND OF THE INVENTION

1. Field of the Invention

The invention generally relates to a channel seal for a sliding window assembly and more specifically, to a channel seal for a sliding window assembly of a vehicle.

2. Description of the Related Art

Sliding window assemblies for vehicles are known in the art. Generally, a sliding window assembly include a first and a second fixed panel configured to be coupled to the vehicle. The first and the second fixed panels are spaced from each other and define an opening therebetween. A sliding panel is slideable relative to the fixed panels between a closed position and an open position to modify a size of the opening.

Typically the sliding window assembly includes an upper track and a lower track spaced from the upper track. Each of the tracks is attached to the fixed panels. The sliding panel is slideable along the tracks between the open and closed positions. Typically, the tracks include an elongated member comprising polyvinyl chloride (PVC). The tracks also include a rail coupled to the elongated member with the elongated member disposed about the rail to present a finished surface. Generally, the rail is W-shape in cross-section defining a first channel for receiving the sliding panel and a second channel for receiving a channel seal. Generally, the channel seal contacts the sliding panel for sealing the first channel to prevent environmental elements, such as environmental elements and debris from entering the first channel. With this particular related art, preventing the environmental elements from entering the first channel prevents the environmental elements from entering the vehicle through the sliding window assembly.

Typically, the channel seal has a finger for contacting the sliding panel and a base extending from the finger. The base of the channel seal has an inner surface proximate to the sliding panel and an outer surface distal to the sliding panel. The second channel is defined such that the rail contacts the inner and outer surfaces of the base of the channel seal to compress the base within the second channel. Because the rail defines the second channel, the tracks have a wide profile, which is generally aesthetically undesirable. Depending on the application, tracks with a narrow profile present a more aesthetically pleasing appearance when the sliding window assembly is installed on the vehicle than the tracks with the wide profile. Additionally, the environmental elements can enter the second channel between the base of the channel seal and the rail. Due to the configuration of the second channel, the second channel retains all the environmental elements that enter the second channel. The environmental elements in the second channel can degrade the channel seal, over time, which can result in separation of the channel seal from the rail. Furthermore, the environmental elements can enter the first channel through the second channel, which defeats the purpose of including the channel seal on the sliding window assembly.

In an effort to provide the track with the narrow profile, rails in the art are typically U-shaped in cross section and only define the first channel for receiving the sliding panel. In this configuration, the rail does not define the second channel. Rather, the elongated member defines the second channel adjacent the rail for receiving the channel seal. Generally, when the elongated member defines the second channel, the channel seal is bonded within the second channel typically by adhesion. When the elongated member defines the second channel, the elongated member is closer to the sliding window and the track has the narrow profile as compared to the rail that is W-shaped in cross section. However, because the elongated member essentially defines the second channel, the environmental elements can enter the second channel between the base of the channel seal and the elongated member. When the elongated member defines the second channel, the environmental elements can degrade the adhesive holding the channel seal within the elongated member in addition to the problems of having the environmental elements within the second channel described above. If the adhesive degrades, the channel seal can separate from the second channel defined by the elongated member. Separation of the channel seal from the second channel defined by the elongated member results in a failure of the channel seal to prevent environmental elements from entering the first channel.

An alternative to having the elongated member define the second channel is to make the channel seal integral with the elongated member. However, when the channel seal is integral with the elongated member, the channel seal must be made from the same material as the elongated member. For example, when the elongated member is made from the PVC, the channel seal that is integral with the elongated member is also made from the PVC. Preferably, the channel seal is made from rubber because rubber is flexible and can completely seal against the sliding panel to prevent the environmental elements from entering the guide channel. When the channel seal is formed from PVC, the channel seal is too ridged to completely seal against the sliding panel. In such configurations, the environmental elements may pass between the channel seal and the sliding panel to enter the channel, which, as described above, can result in environmental elements entering the vehicle. Additionally, making the channel seal integral with the elongated member can result in imperfections in the channel seal during the forming of the channel seal, which can also prevent the channel seal from completely sealing against the sliding panel. Furthermore, having the channel seal integral with the elongated member prevents the channel seal from being replaced without replacing the entire sliding window assembly in the event the channel seal becomes worn.

SUMMARY OF THE INVENTION AND ADVANTAGES

The present invention includes a sliding window assembly for a vehicle. The sliding window assembly comprises a first fixed panel configured for coupling with the vehicle and a second fixed panel configured for coupling with the vehicle. The second fixed panel is spaced from the first fixed panel. An opening is defined between the first and second fixed panels. A track is connected to the first fixed panel and to the second fixed panel. The track defines a U-shaped channel. The sliding window assembly also comprises a sliding panel disposed within the channel. The sliding panel is moveable relative to the first and second fixed panels along the track for covering and uncovering the opening. The sliding window assembly further includes a channel seal having a finger contacting the sliding panel and a base extending from the finger. The base is coupled to the track for sealing the channel from environmental elements. The channel seal prevents the environmental elements from entering the channel, which ultimately prevents the environmental elements from entering an interior of the vehicle.

BRIEF DESCRIPTION OF THE DRAWINGS

Advantages of the present invention will be readily appreciated, as the same becomes better understood by reference to the following detailed description when considered in connection with the accompanying drawings wherein:

FIG. 8 is a partial view of a sliding panel for the sliding window assembly with a cable molded within a bracket that is coupled to the sliding panel;

FIG. 11A is an alternative embodiment of the sliding window assembly of FIG. 6; and FIG. 11B is another alternative embodiment of the sliding window assembly of FIG. 6.

DETAILED DESCRIPTION OF THE EXEMPLARY EMBODIMENT

Figure 1:
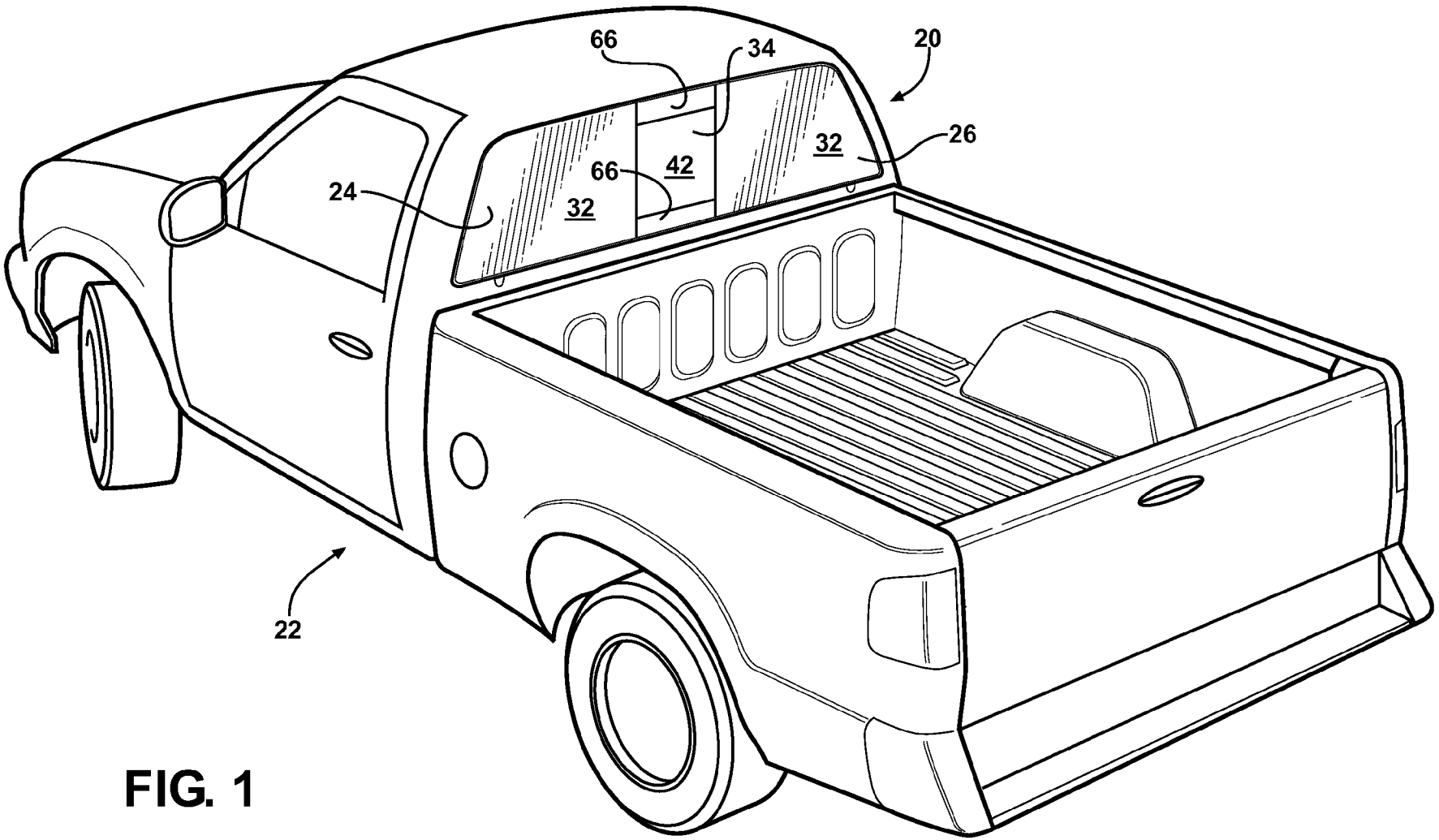
FIG. 1 is a perspective view of a vehicle with a sliding window assembly installed on the vehicle.

Referring to the Figures, wherein like numerals indicate corresponding parts throughout the several views, a sliding window assembly 20 for use in a vehicle 22 is generally shown. Referring to FIG. 1, the sliding window assembly 20 is shown coupled to the vehicle 22, specifically as a backlite of a pickup truck. However, it is to be appreciated that the sliding window assembly 20 of the present invention can be implemented in other types of vehicles, as well as in non-vehicle applications.

Figure 2:
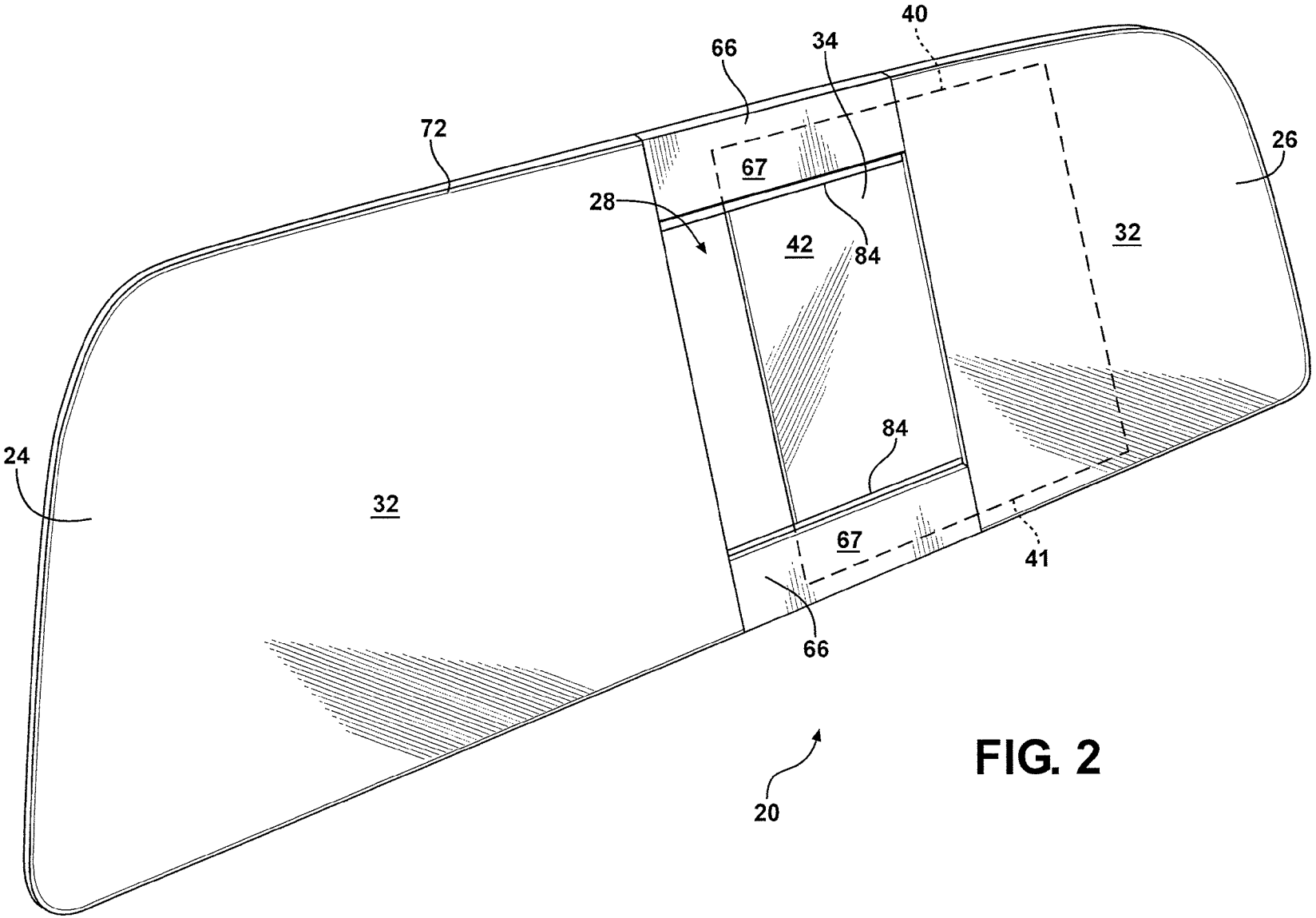
FIG. 2 is a perspective view of an exterior of the sliding window assembly.
Figure 3:
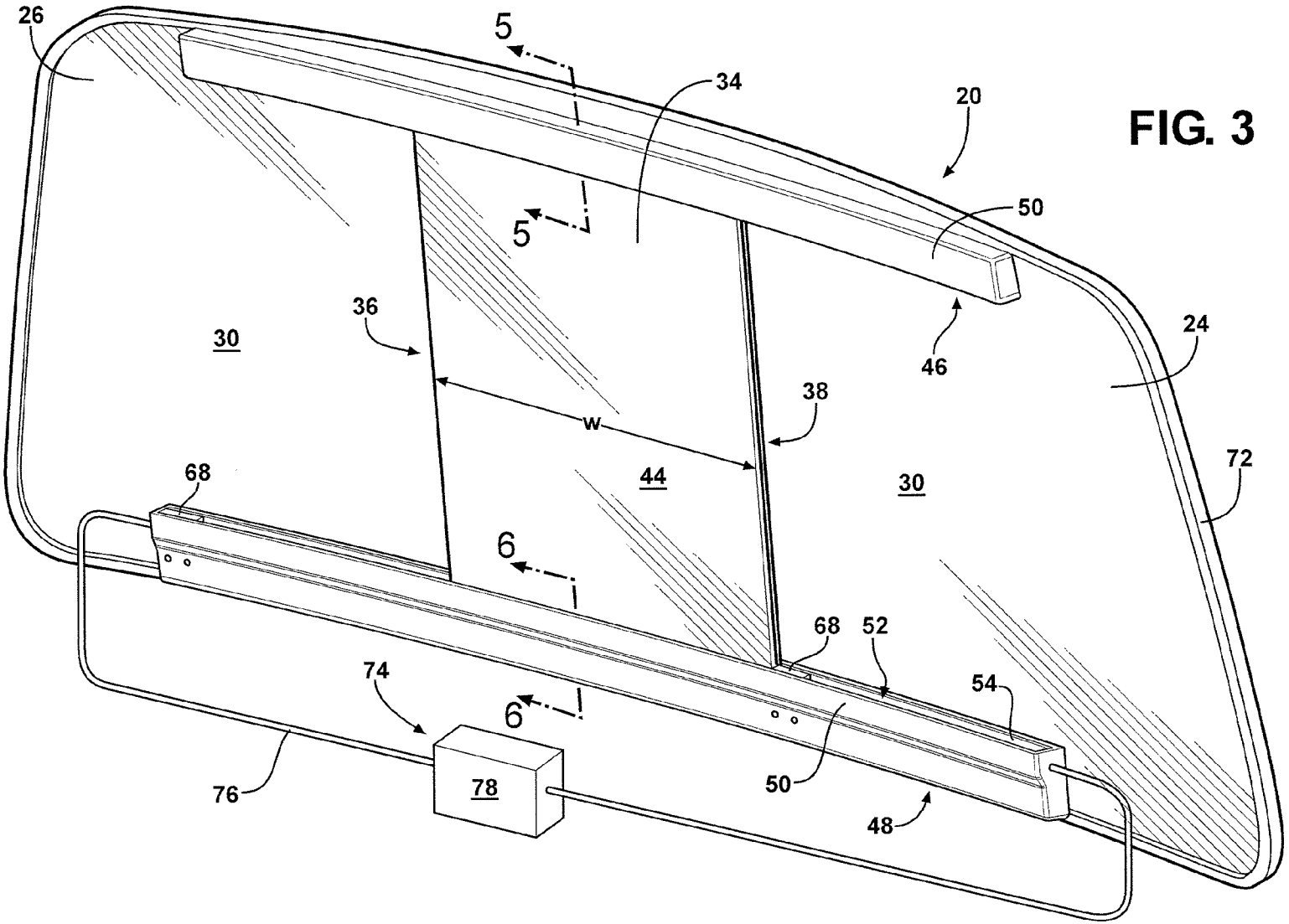
FIG. 3 is a perspective view of an interior of the sliding window assembly.

Generally, the sliding window assembly 20 includes at least one fixed panel 24, 26 configured for coupling with the vehicle 22. For example, the fixed panel 24, 26 may include a gasket with the gasket connected to the vehicle. Alternatively, an adhesive may be applied to the fixed panel 24, 26, and the fixed panel 24, 26 is directly connected to the vehicle 22 through the adhesive. As shown in FIGS. 1 through 3, the at least one fixed panel 24, 26 includes a first fixed panel 24 and a second fixed panel 26 spaced from the first fixed panel 24 defining an opening 28 therebetween. The first and second fixed panels 24, 26 are typically formed of glass. However, the first and second fixed panels 24, 26 may be formed from any suitable material such as plastic or metal.

The first and second fixed panels 24, 26 have an interior surface 30 for facing an interior of the vehicle 22 when the sliding window assembly 20 is coupled to the vehicle 22. The first and second fixed panels 24, 26 also have an exterior surface 32 for facing an exterior of the vehicle 22 when the sliding window assembly 20 is coupled to the vehicle 22.

A sliding panel 34 is moveable relative to the first and second fixed panels 24, 26 for covering the opening 28 in a closed position and for uncovering the opening 28 in an open position. The sliding panel 34 is covering the opening 28 in a closed position in FIGS. 1 and 3 and is partially covering the opening 28 between the open and closed positions in FIG. 2. The sliding panel 34 has a first edge 36 and a second edge 38 spaced from the first edge 36 defining a width W of the sliding panel 34 therebetween. The sliding panel 34 also has a top edge 40 and a bottom edge 41 spaced from the top edge 40. The sliding panel 34 is disposed in an offset relationship to the first and second fixed panels 24, 26. Said differently, the first edge 36 of the sliding panel 34 overlaps the first fixed panel 24 and the second edge 38 of the sliding panel 34 overlaps the second fixed panel 26 when the sliding panel 34 is in the closed position. It is to be appreciated that the sliding panel 34 may be flush with the exterior surface 32 of the fixed panels 24, 26 without departing from the scope of the present invention for example, when the first and second tracks 46, 48 and other components are modified.

The sliding panel 34 presents an exterior surface 42 and an opposing interior surface 44 with the exterior surface 42 of the sliding panel 34 facing the exterior of the vehicle 22 and the interior surface 44 of the sliding panel 34 facing the interior of the vehicle 22 when the sliding window assembly 20 is coupled to the vehicle 22. Like the first and second fixed panels 24, 26, the sliding panel 34 is typically formed of glass, but can be formed of any suitable material such as plastic and metal.

Figure 5:
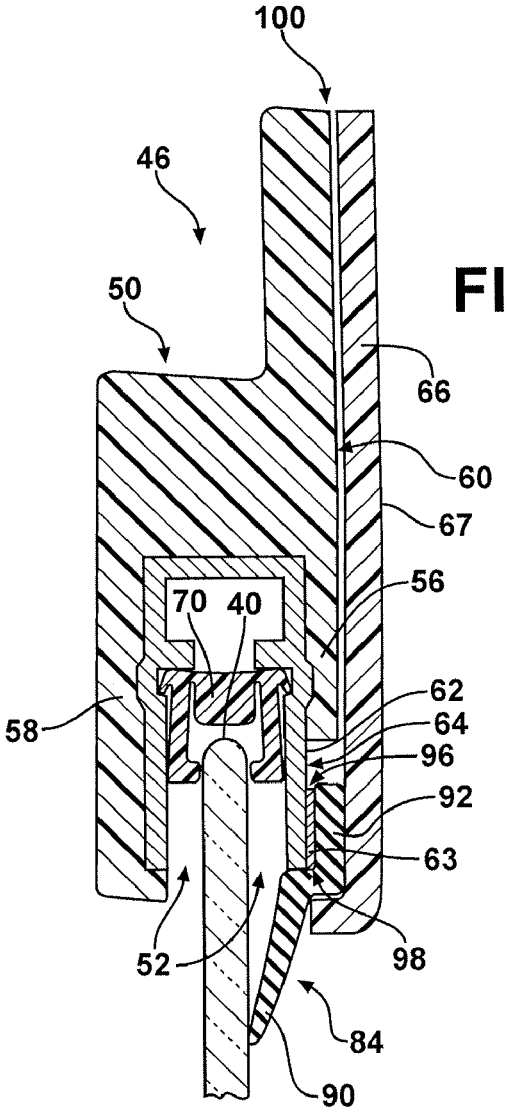
FIG. 5 is a cross-sectional view taken along line 5-5 of FIG. 3 showing a channel seal coupled to a first track of the sliding window assembly.
Figure 6:
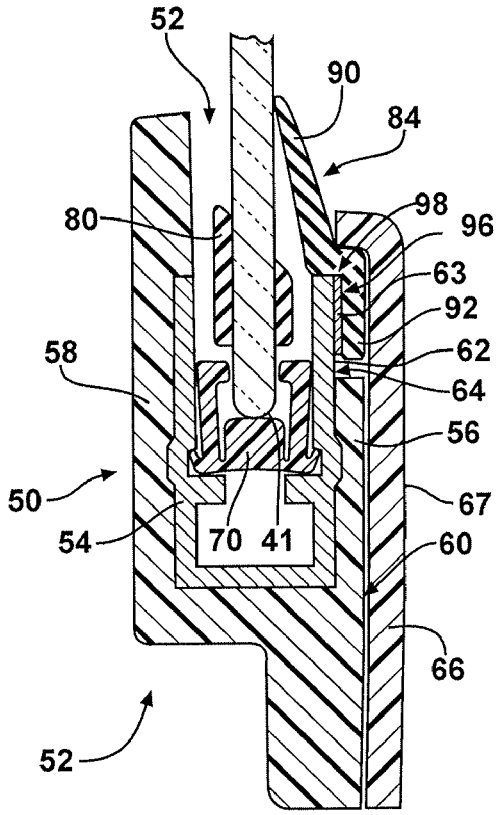
FIG. 6 is a cross-sectional view taken along line 6-6 of FIG. 3 showing the channel seal coupled to a second track of the sliding window assembly.

Generally, the sliding window assembly 20 includes at least one track 46, 48, commonly referred to throughout the industry as a run channel. The track 46, 48 is connected to the first fixed panel 24 and to the second fixed panel 26, which is described below. Referring to FIGS. 5 and 6, typically the track 46, 48 includes an elongated member 50 defining a U-shaped channel 52 and a rail 54 disposed in the channel 52. The elongated member 50 is coupled to and extends between the first and second fixed panels 24, 26. The elongated member 50 includes a first side wall 56 adjacent the fixed panels 24, 26 and a second side wall 58 spaced from the first side wall 56. The channel 52 is defined between the first and second side walls 56, 58. The first side wall 56 of each elongated member 50 presents a mounting surface 60 which is described in detail below.

The rail 54 is partially encompassed by the elongated member 50 to expose a portion 62 of an exterior surface 64 of the rail 54 spaced from the elongated member 50. The rail 54 provides structural reinforcement to the elongated member 50. The rail 54 is typically U-shaped to fit within the channel 52 of the elongated member 50. Typically, the rail 54 comprises aluminum; however, it is to be appreciated that the rail 54 may comprise any suitable material without deviating from the scope of the subject invention. It is to be appreciated that the tracks 46, 48 may be manufactured without the elongated member 50 such that the rail 54 is connected directly to the first and second fixed panels 24, 26. Alternatively, the tracks 46, 48 may be manufactured without the rail 54.

As shown in FIG. 3, the at least one track 46, 48 includes a first track 46 coupled to the first and second fixed panels 24, 26 and a second track 48 coupled to the first and second fixed panels 24, 26 spaced from and substantially parallel to the first track 46. The first and second tracks 46, 48 rigidly interconnect the first and second fixed panels 24, 26. The first and second tracks 46, 48 span the opening 28 defined between the first and second fixed panels 24, 26.

The first and second tracks 46, 48 are typically coupled to the first and second fixed panels 24, 26 by adhesive surface bonding. Although not required, the adhesive surface bonding can be a process commonly referred to in the industry as glass encapsulation. The glass encapsulation can be a single-sided encapsulation, a two-sided encapsulation, or a three-sided encapsulation. For example, with the single-sided encapsulation, the first and second tracks 46, 48 are coupled to the interior surface 30 of the first and second fixed panels 24, 26 leaving the exterior surface 32 of the first and second fixed panels 24, 26 free of adhesive surface bonding. It should be appreciated that the adhesive surface bonding can be any type of adhesive surface bonding other than glass encapsulation without departing from the nature of the present invention.

Figure 7:
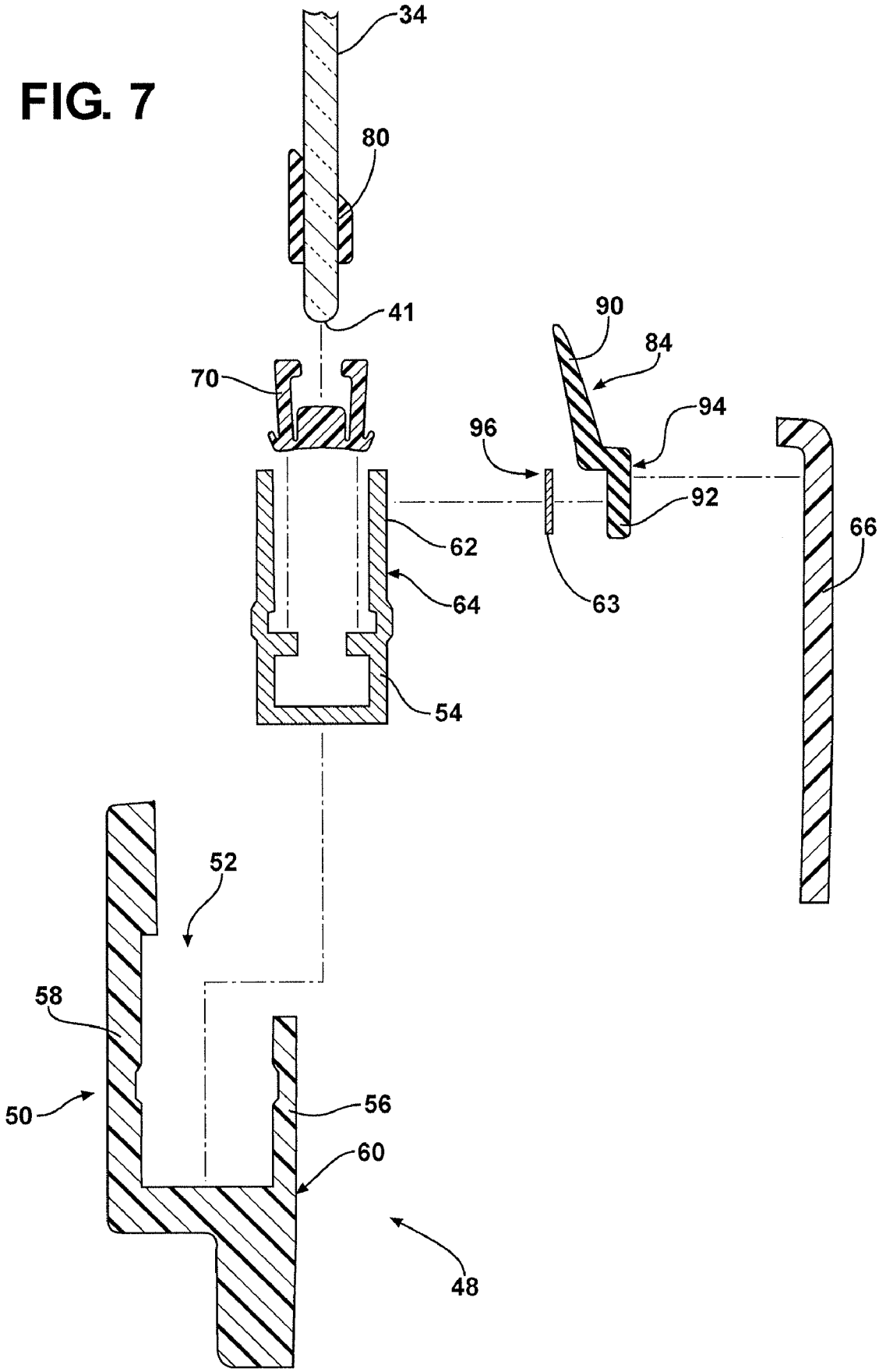
FIG. 7 is an exploded assembly view of the cross-sectional view of FIG. 6.

Generally, the glass encapsulation results in an encapsulant that can be used to couple the first and second tracks 46, 48 to the first and second fixed panels 24, 26. When formed by glass encapsulation, the encapsulant typically comprises polyvinyl chloride (PVC). However, it should be appreciated that the encapsulant may be formed from any type of material suitable for glass encapsulation. When the glass encapsulation is employed, the first and second tracks 46, 48 are formed, at least partially, from the encapsulant. Specifically, with respect to glass encapsulation, the elongated member 50 is formed of the encapsulant and is coupled to the first and second fixed panels 24, 26 by glass encapsulation. Furthermore, the rail 54 may also be coupled to the elongated member 50 during the glass encapsulation such that the encapsulant at least partially encompasses the exterior surface 64 of the rail 54. In such an embodiment, the first and second tracks 46, 48 are each integral with the first and second fixed panels 24, 26. Specifically, the elongated member 50 of the first track 46 is integral with the rail 54 of the first track 46 and with the first and second fixed panels 24, 26. Likewise, the elongated member 50 of the second track 48 is integral with the rail 54 of the second track 48 and with the first and second fixed panels 24, 26. In other words, the first and second tracks 46, 48 and the first and second fixed panels 24, 26 form a single continuous unit. It should be appreciated that even though the elongated member 50 and the rail 54 are integral, the elongated member 50 and the rail 54 are shown in an exploded view in FIGS. 4 and 7 in order to show details of these parts.

With reference to FIGS. 5 and 6, although not required, an applique 66 is coupled to each of the tracks 46, 48 and spaced from the elongated member 50. The applique 66 is mounted to the mounting surface 60 of each elongated member 50 for providing a decorative appearance to the sliding window assembly 20. Specifically, the applique 66 is situated in the opening 28 between the first and second fixed panels 24, 26 along the first and second tracks 46, 48. The applique 66 has a finished surface 67 that is flush with the exterior surface 32 of the fixed panels 24, 26. The applique 66 is typically formed of a polycarbonate plastic, but can be formed of other plastics, glass, metal, and the like. In the configuration where the encapsulant is the elongated member 50, the applique 66 is typically attached to the elongated member 50 by glass encapsulation. However, it should be appreciated that the applique 66 may be attached to the elongated member 50 in any fashion, for example by adhesive.

Referring to FIG. 3, the sliding panel 34 is disposed within the first and second tracks 46, 48. Generally, the sliding panel 34 is disposed within the channel 52 of the tracks 46, 48 and moveable relative to said first and second fixed panels 24, 26 along the tracks 46, 48. The top edge 40 of the sliding panel 34 is received in the channel 52 of the elongated member 50 of the first track 46 and the bottom edge 41 of the sliding panel 34 is received in the channel 52 of the elongated member 50 of the second track 48. The sliding panel 34 is in sliding engagement with the first and second tracks 46, 48 and is slideable along the first and second tracks 46, 48 relative to the first and second fixed panels 24, 26. Generally, the bottom edge 41 of the sliding panel 34 is in sliding engagement with the second track 48. The first and second tracks 46, 48 guide the sliding panel 34 as the sliding panel 34 moves between the closed and open positions.

The sliding panel 34 typically slides horizontally along the first and second tracks 46, 48, but it should be appreciated that the sliding panel 34 can also slide in other directions, e.g. vertically, without departing from the nature of the present invention. In FIG. 3 the sliding panel 34 slides to the left to the open position and slides to the right to the closed position, but it should be appreciated that the sliding panel 34 can slide in any direction between the open and closed position without departing from the nature of the present invention. It should also be appreciated that the sliding panel 34 can slide in more than one direction from the closed to the open positions. Typically, when the sliding panel 34 is moveable horizontally, the first and second tracks 46, 48 extend generally horizontally along the periphery of the first and second fixed panels 24, 26. Alternatively, when the sliding panel 34 is moveable vertically, the first and second tracks 46, 48 extend generally vertically between the periphery of the first and second fixed panels 24, 26.

Although not required, FIGS. 5 and 6 shown a channel insert 70 fixed within each of the first and the second tracks 46, 48. When the channel insert 70 is present, at least the bottom edge 41 of the sliding panel 34 is in sliding engagement with the channel insert 70 and the sliding panel 34 is slidable along the channel insert 70. The channel insert 70 reduces a coefficient of friction between the sliding panel 34 and the tracks 46, 48 for reducing a work required to move the sliding panel 34 between the open and closes positions. The channel insert 70 is fixed within the first and second tracks 46, 48 to prevent the channel insert 70 from moving along the first and second tracks 46, 48.

With reference to FIGS. 2 and 3, although not required, the sliding window assembly can include a frame member 72 surrounding a periphery of the first and second fixed panels 24, 26. The frame member 72 may be integral with the first and second tracks 46, 48. The frame member 72 can comprise any suitable material such as plastic and metal.

The sliding window assembly 20 can be either a manual sliding window assembly or a power sliding window assembly without departing from the scope of the subject invention. With reference to FIG. 3, sliding window assembly 20 may include a cable drive system 74 commonly referred to throughout the industry as a pull-pull cable drive system when the sliding window assembly 20 is the power sliding window assembly. The cable drive system 74 is coupled to the sliding panel 34 for moving the sliding panel 34 along the tracks 46, 48 to cover and uncover the opening. Typically, the cable drive system 74 includes at least one cable 76 coupled to the sliding panel 34 and a motor 78, such as a linear motor. The motor 78 rotates for winding the cable 76 about the motor 78 in the direction of rotation, i.e., clockwise or counterclockwise. The cable 76 is also coupled to the sliding panel 34 for moving the sliding panel 34 as the motor 78 rotates. More specifically, when the motor 78 rotates clockwise, tension on the cable 76 applies a force to the sliding panel 34 in a direction to modify the size of the opening 28, i.e., the sliding panel 34 slides from the closed position to the open position, or from the open position to the closed position. The sliding panel 34 slides back in an opposite direction when the motor 78 is rotated counterclockwise.

Referring to FIG. 8, when the cable drive system 74 is present, the sliding panel 34 includes at least one bracket 80 coupled to the sliding panel 34 within the channel 52 proximate to the bottom edge 41 of the sliding panel 34. Generally, the bracket 80 couples the cable drive system 74 to the sliding panel 34 to allow the cable drive system 74 to move the sliding panel 34. The bracket 80 couples the cable 76 to the sliding panel 34 for allowing the force to be transferred from the cable 76 to the sliding panel 34 to slide the sliding panel 34 within the sliding window assembly 20.

Figure 4:
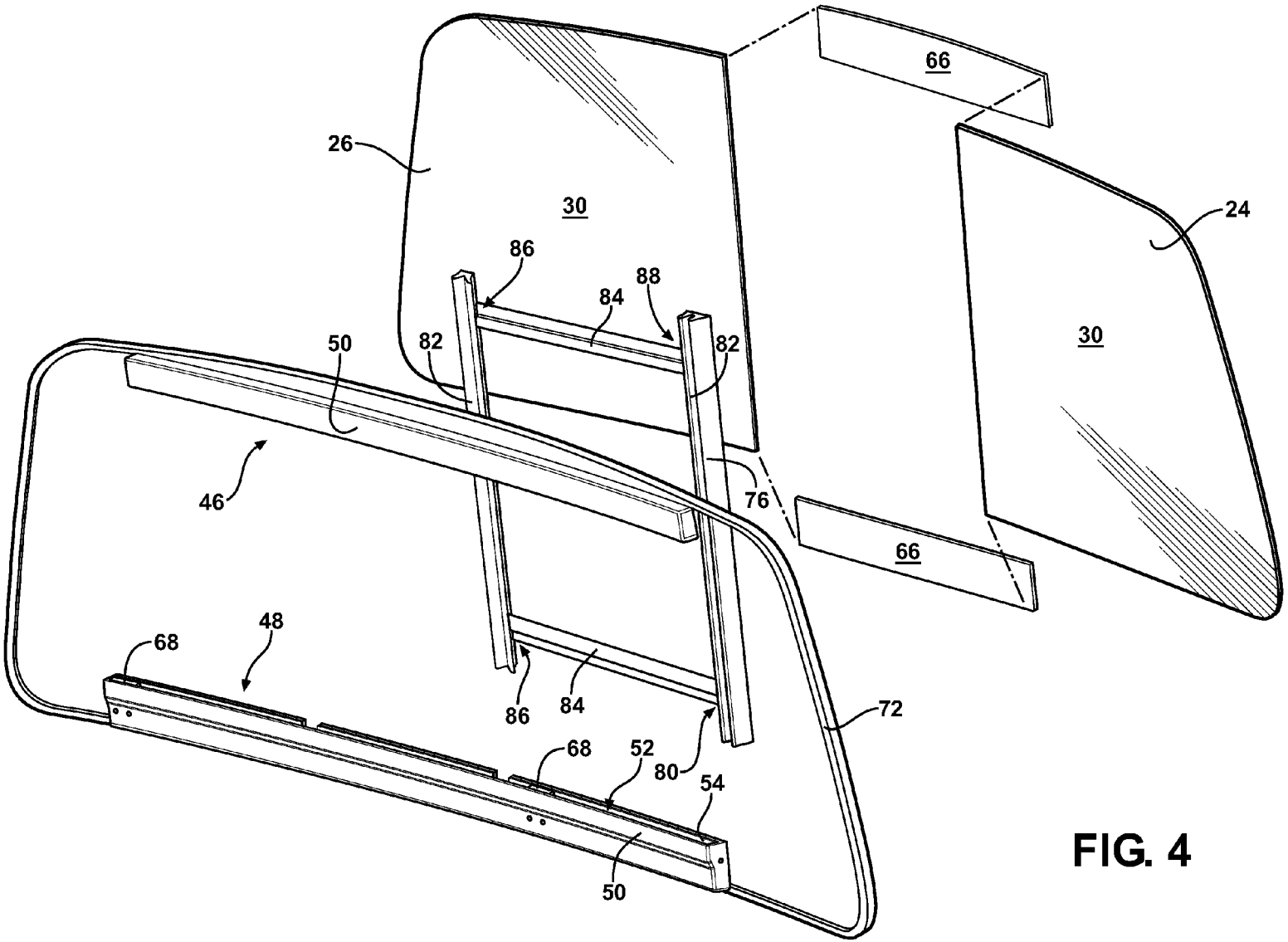
FIG. 4 is an exploded perspective view of the sliding window assembly.

As shown in FIG. 4, the sliding window assembly 20 includes a pair of vertical seals 82. Each of the vertical seals 82 is coupled to a respective one of the first and second fixed panels 24, 26 between the first and second tracks 46, 48. The vertical seals 82 contact the sliding panel 34 when the sliding panel 34 is in the closed position. When the sliding panel 34 is in the open position, only one of the vertical seals 82 contacts the sliding panel 34. The vertical seals 82 are typically coupled, e.g. adhered, to the first and second fixed panels 24, 26 with tape. However, it should be appreciated that the vertical seals 82 may be coupled to the first and second fixed panels 24, 26 in any fashion, for example, with adhesive.

Figure 9:
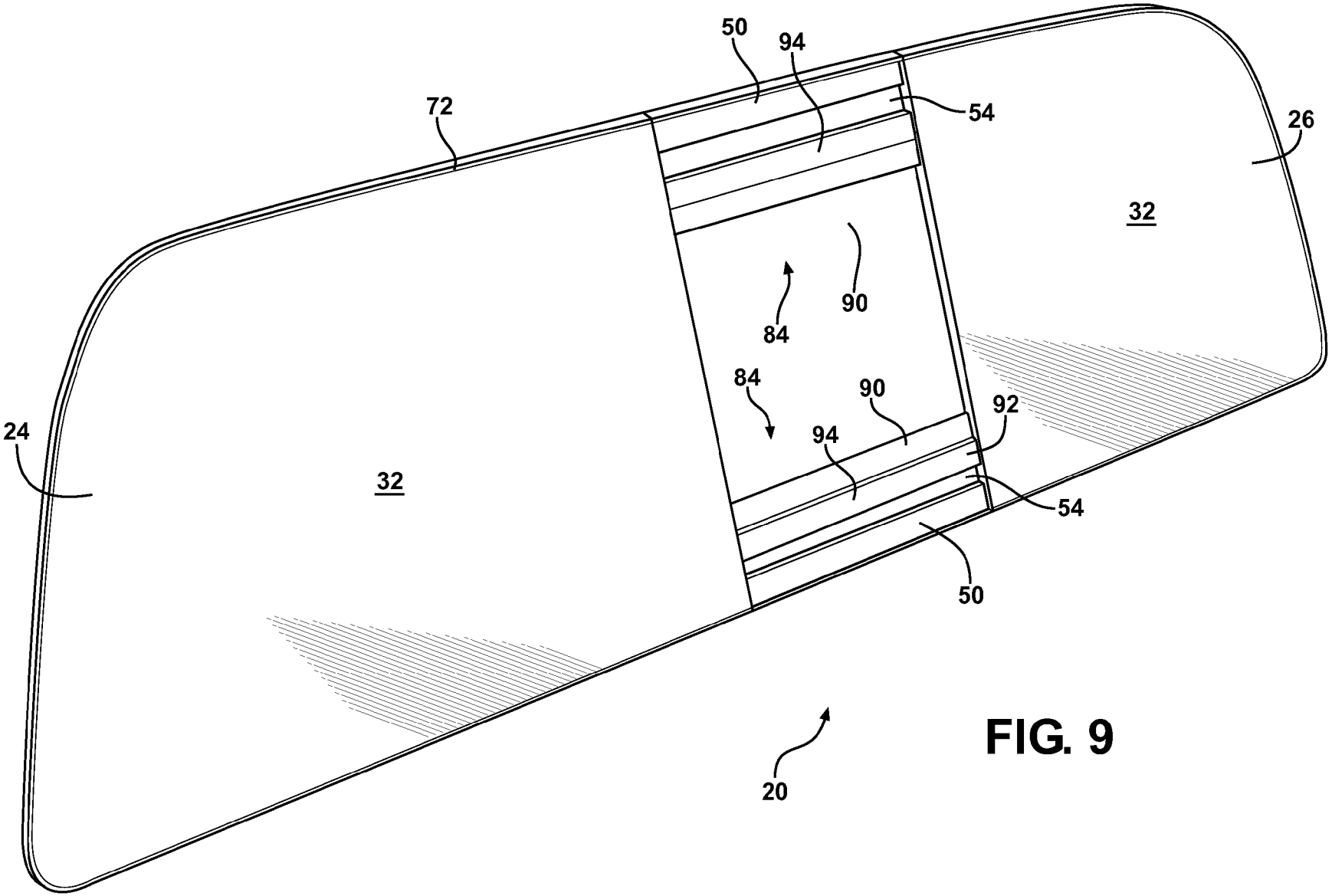
FIG. 9 is a perspective view of the sliding window assembly showing the channel seal coupled to the first and second tracks.

Referring to FIGS. 4 through 6, the sliding window assembly also includes a channel seal 84 coupled to the at least one track 26, 38. Typically, when the sliding window assembly 20 includes the first and second tracks 46, 48, each of the tracks 46, 48 includes the channel seal 84. However, it should be appreciated that only one of the first and second tracks 46, 48 may include the channel seal 84. Generally, the channel seal 84 contacts the sliding panel 34 for sealing the channel 52 from environmental elements, such as water and debris. Referring to FIG. 9, the channel seal 84 typically has a first end 86 abutting the first fixed panel 24 and a second end 88 abutting the second fixed panel 26. The channel seal 84 extends substantially parallel to the elongated member 50 and substantially parallel to the direction of movement of the sliding panel 34 as the sliding panel 34 moves along the tracks 46, 48. It is to be appreciated that the channel seal 84 does not have to be exactly parallel to either the elongated member 50 or the movement of the sliding panel. It is to be appreciated that the channel seal 84 contacts the sliding panel 34 when the sliding panel 34 is in the open position, closed position, or any position in between.

The channel seal 84 has a finger 90 contacting the sliding panel 34 and a base 92 extending from the finger 90. The environmental elements from the sliding panel 34 are directed along the finger 90 and then along the base 92 for draining the environmental elements from the sliding panel 34 to the exterior of the vehicle 22. When present, the bracket 80 is coupled to the sliding panel 34 within the channel 52 below the finger 90 to seal the bracket 80 within the channel 52 and to prevent the environmental elements from contacting the bracket 80. The base 92 of the channel seal 84 has an outer surface 94 adjacent the applique 66.

Typically, an attachment element 96 is disposed on the base 92 for coupling the channel seal 84 to said track 46, 48. The attachment element 96 may be integral with the base 92. For example, as shown in FIG. 11A, the base 92 may include a male portion 93 extending from and integral with the base 92 for mating with a hole 95 defined by the track 46, 48 to coupling the base 92 to the track 46, 48. Alternatively, the attachment element 96 may be a discrete component relative to the base 92. For example, the attachment element 96 may be a tape, an adhesive film, an encapsulant, or a mechanical coupling. Typically, when employed, the adhesive tape 63 is an acrylic tape. When the attachment element 96 is the discrete component, the attachment element 96 may be applied to the base 92 by any acceptable method. The channel seal 84 may be formed directly on the track 46, 48 such that the formation of the channel seal 84 coupled the channel seal 84 to the track 46, 48, which eliminates the attachment element 96. It should be appreciated that the channel seal 84 may be coupled to the first and second tracks 46, 48 in any fashion.

When the attachment element 96 and the rail 54 are present, the base 92 is mounted directly to the portion 62 of the rail 54 through the attachment element 96. When the channel seal 84 is made from EPDM rubber and the rail 54 is made from aluminum, the EPDM rubber channel seal is mounted to the aluminum rail. Because the rail 54 does not define a second channel for receiving the channel seal 84, the attachment element 96 does not require compression of the channel seal 84 for retaining the channel seal 84 against the rail 54 of the tracks 46, 48. It is to be appreciated that the attachment element 96, as shown in the Figures, is only a representation and is not drawn to scale. For example, the attachment element may be a thin film of adhesive.

Figure 10:
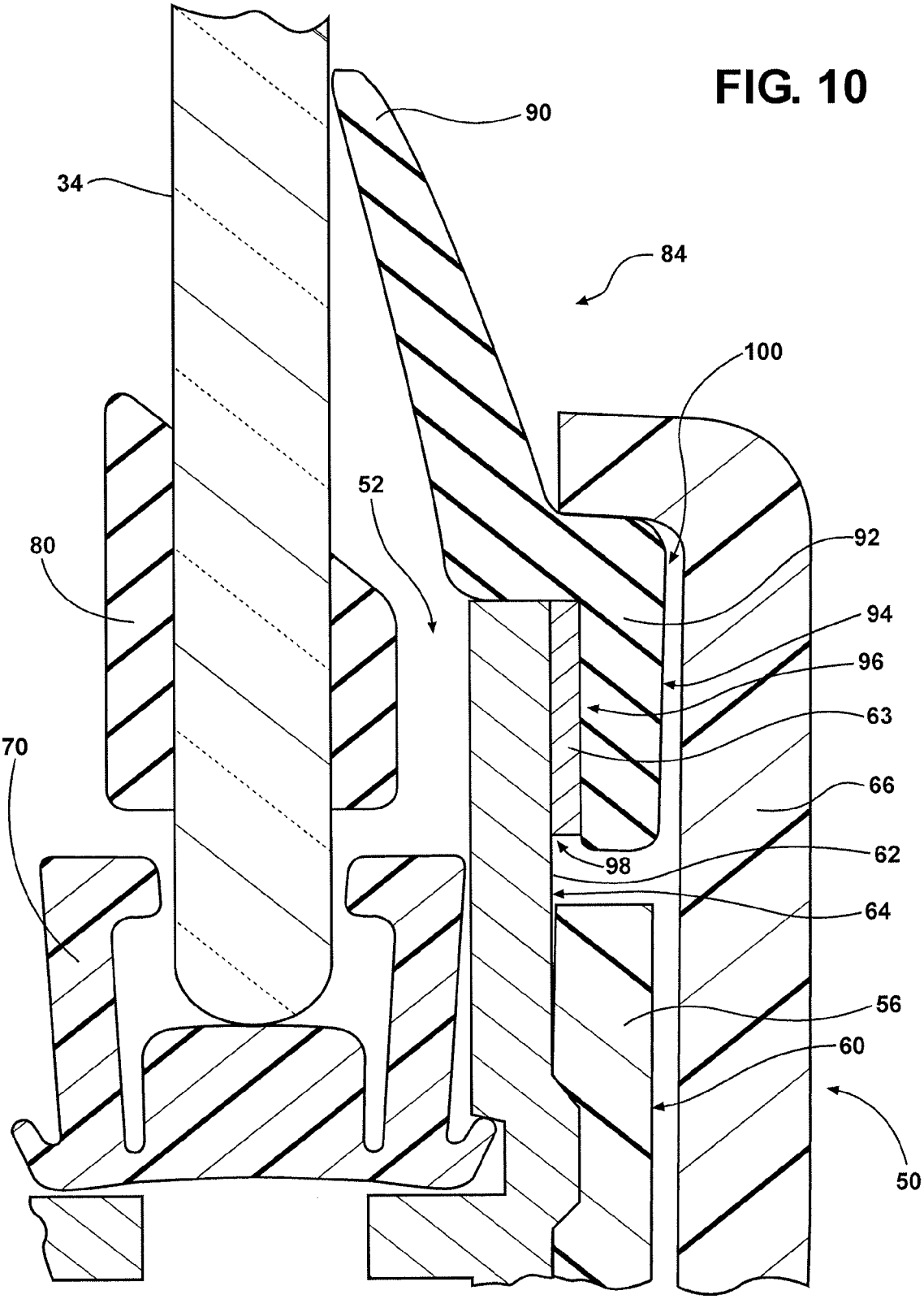
FIG. 10 is an enlarged view of a portion of the cross section of FIG. 6.

Referring to FIGS. 6 and 10, mounting the base 92 to the portion 62 of the rail 54 through the attachment element 96 establishes a mounting point 98 between the rail 54 and the channel seal 84 for securing the channel seal 84 to the rail 54. The mounting point 98 of the channel seal 84 is isolated from the environmental elements. Said differently, because the elongated member 50 does not contact the outer surface 94 of the channel seal 40, the elongated member does not retain the environmental elements and the environmental elements will drain by gravity. Allowing the environmental elements to drain prevents a collection of the environmental elements around the channel seal 84 and the environmental elements cannot come into contact with the mounting point 98.

Typically, the applique 66 and the tracks 46, 48 define a drain port 100 therebetween for draining the environmental elements from the channel seal 84 to the exterior of the vehicle 22. It is to be appreciated that the drain port 100 as shown in the Figures is only a representation and is not drawn to scale and a visible space between the applique 66 and the channel seal 84 or the elongated member 50 may or may not exist. When the elongated member 50 is present, the elongated member 50 at least partially defines the drain port 100. Generally, the applique 66 and the elongated member 50 collectively define the drain port 100. The drain port 100 continues between the outer surface 94 of the base 92 and the applique 66 for draining the environmental elements from the channel seal 84. Allowing the environmental elements to drain from the channel seal 84 prevents the environmental elements from collecting within the elongated member 50 around the channel seal 84 thereby preventing the environmental elements from entering the channel 52 and, ultimately, the interior of the vehicle 22.

In one embodiment, the elongated member 50 does not contact the attachment element 96. When the elongated member 50 does not contact the attachment element 96, the first side wall 56 of the elongated member 50 is adjacent the applique 66 and is below the channel seal 84. Having the elongated member 50 below the channel seal 84 prevents the elongated member 50 from retaining the environmental elements against the channel seal 84, which prevents the environmental elements from migrating between the channel seal 84 and the rail 54. Furthermore, the channel seal 84 is typically spaced from the elongated member 50 thereby defining a gap between the channel seal 84 and the elongated member 50. Spacing the elongated member 50 from the channel seal 84 provides additional protection against the elongated member 50 retaining the environmental elements against the channel seal 84. Alternatively, as shown in FIG. 11B, the channel seal 84 may be coupled to the elongated member 50. When the channel seal 84 is coupled to the elongated member 50, the elongated member 50 itself can be the attachment element 96. However, elongated member 50 does not contact the outer surface 94 of the channel seal 84. Because the elongating member 40 does not contact the outer surface 94 the channel seal 84, a second channel that can collect the environmental elements is not formed adjacent the rail 54.

Typically, the vertical seals 82 and the channel seal 84 coupled to the first track 46 are integral with each other such that the vertical seals 82 and the channel seal 84 coupled to the first track 46 is a one-piece seal. When such a one-piece seal is employed, the channel seal 84 coupled to the first track 46 is included in the one-piece seal and the channel seal 84 coupled to the second track 48 is not included in the one-piece seal. It is to be appreciated that the vertical seals 82 and the channel seal 84 coupled to the first and second tracks 46, 48 may be integral with one another without departing from the scope of the present invention. It is also to be appreciated that the vertical seals 82 and the channel seal 84 coupled to the first and second tracks 46, 48 may each be a discrete component relative to each other.

The vertical seals 82 and the channel seal 84 are formed of any suitable material without departing from the nature of the present invention. The vertical and channel seals 82, 84 are preferably formed from ethylene propylene diene monomer rubber (EPDM rubber). Alternatively, for example, the vertical and channel seals 82, 84 are formed from thermoplastic vulcanizates or thermoplastic elastomer. Typically, the vertical and channel seals 82, 84 are applied after the adhesive surface bonding, e.g. the glass encapsulation of the first and second tracks 46, 48 to the first and second fixed panels 24, 26, but can be applied at any time.

Although the channel seal 84 has been described for use with the sliding panel 34 slidable horizontally, those skilled in the art will appreciate that the channel seal 84 can be used in other sliding window assemblies wherein, for example the sliding panel 34 is slidable vertically without departing from the scope of the subject invention. Additionally, the channel seal 84 can be utilized in either the manual or the power sliding window assembly without departing from the scope of the subject invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A sliding window assembly for a vehicle, said sliding window assembly comprising:

a first fixed panel configured for coupling with the vehicle;

a second fixed panel configured for coupling with the vehicle and spaced from said first fixed panel defining an opening therebetween;

a track connected to said first fixed panel and to said second fixed panel and including an elongated member defining a U-shaped channel and a rail disposed in said channel and partially encompassed by said elongated member to expose a portion of said rail with said portion extending beyond said elongated member and toward said opening;

a sliding panel disposed within said channel and moveable relative to said first and second fixed panels along said track for covering and uncovering said opening;

a channel seal having a finger contacting said sliding panel and a base extending from said finger with an attachment element disposed on said base and an inner surface of said base mounted directly to said portion of said rail by said attachment element to establish a mounting point between said rail and said channel seal for securing said channel seal to said rail an applique covering and spaced apart from an outer surface of said base of said channel seal and an outer surface of said elongated member; and wherein said mounting point of said channel seal is isolated from environmental elements.

2. A sliding window assembly as set forth in claim 1 wherein said elongated member at least partially defines a drain port.

3. A sliding window assembly as set forth in claim 2 wherein with said applique and said elongated member collectively define said drain port.

4. A sliding window assembly as set forth in claim 3 wherein said base of said channel seal has an outer surface adjacent said applique and wherein said drain port continues between said outer surface of said base and said applique for draining the environmental elements from said channel seal.

5. A sliding window assembly as set forth in claim 3 wherein said elongated member has a first side wall adjacent said applique that is below said channel seal.

6. A sliding window assembly as set forth in claim 1 wherein said elongated member does not contact said attachment element.

7. A sliding window assembly as set forth in claim 6 wherein said channel seal is spaced from said elongated member thereby defining a gap between said channel seal and said elongated member.

8. A sliding window assembly as set forth in claim 1 wherein said channel seal extends substantially parallel to said elongated member and substantially parallel to a direction of movement of said sliding panel as said sliding panel moves along said track.

9. A sliding window assembly as set forth in claim 8 wherein said channel seal has a first end abutting said first fixed panel and a second end abutting said second fixed panel.

10. A sliding window assembly as set forth in claim 9 further comprising a cable drive system coupled to said sliding panel for moving said sliding panel along said track to cover and uncover said opening.

11. A sliding window assembly as set forth in claim 10 further comprising a bracket coupled to said sliding panel within said channel and below said finger for coupling said cable drive system to said sliding panel to allow said cable drive system to move said sliding panel.

12. A sliding window assembly as set forth in claim 1 wherein said channel seal comprises ethylene propylene diene monomer rubber.

13. A sliding window assembly for a vehicle, said sliding window assembly comprising:

a first fixed panel configured for coupling with the vehicle;

a second fixed panel configured for coupling with the vehicle and spaced from said first fixed panel defining an opening therebetween;

a track connected to said first fixed panel and to said second fixed panel and defining a U-shaped channel;

a sliding panel disposed within said channel and moveable relative to said first and second fixed panels along said track for covering and uncovering said opening;

a channel seal having a finger contacting said sliding panel and a base extending from said finger and coupled to said track for sealing said channel from environmental elements; and an applique coupled to and spaced from said track with said applique and said track defining a drain port therebetween for draining the environmental elements from said channel seal to an exterior of the vehicle;

wherein said channel seal has an outer surface adjacent said applique and wherein said drain port continues between said outer surface and said applique for draining the environmental elements from said channel seal to an exterior of the vehicle.

14. A sliding window assembly as set forth in claim 13 wherein said track includes an elongated member with said channel seal coupled to said elongated member.

15. A sliding window assembly as set forth in claim 14 wherein said elongated member does not contact said outer surface of said channel seal.

16. A sliding window assembly as set forth in claim 14 wherein said track further includes a rail disposed within said channel with said rail partially encompassed by said elongated member to expose a portion of said rail.

17. A sliding window assembly as set forth in claim 16 wherein said elongated member is an attachment element disposed on said base with said base mounted directly to said portion of said rail through said attachment element to establish a mounting point between said rail and said channel seal for securing said channel seal to said rail wherein said mounting point of said channel seal is isolated from the environmental elements.

18. A sliding window assembly as set forth in claim 13 wherein said channel seal extends substantially parallel to said elongated member and substantially parallel to a direction of movement of said sliding panel as said sliding panel moves along said track.

19. A sliding window assembly as set forth in claim 18 wherein said channel seal has a first end abutting said first fixed panel and a second end abutting said second fixed panel.

20. A sliding window assembly as set forth in claim 19 further comprising a cable drive system coupled to said sliding panel for moving said sliding panel along said track to cover and uncover said opening.

21. A sliding window assembly as set forth in claim 20 further comprising a bracket coupled to said sliding panel within said channel and below said finger of said seal for coupling said cable drive system to said sliding panel to allow said cable drive system to move said sliding panel.

22. A sliding window assembly as set forth in claim 13 wherein said channel seal comprises ethylene propylene diene monomer rubber.

* * * * *

UNITED STATES PATENT AND TRADEMARK OFFICE

CERTIFICATE OF CORRECTION

PATENT NO. : 8,322,075 B2
APPLICATION NO. : 12/621267
DATED : December 4, 2012
INVENTOR(S) : David W. Lahnala It is certified that error appears in the above-identified patent and that said Letters Patent is hereby corrected as shown below:

In the Claims:

Column 10, line 18, after “to said rail”,” insert -- ; --.

Column 10, line 18, before “an applique”, insert new paragraph.

Column 10, line 21, before “wherein”, insert new paragraph.

Signed and Sealed this
Sixth Day of August, 2013

Teresa Stanek Rea

Teresa Stanek Rea
*Acting Director of the United States Patent and Trademark Office*